US009579535B2

(12) United States Patent
Markowitz

(10) Patent No.: US 9,579,535 B2
(45) Date of Patent: Feb. 28, 2017

(54) EXERCISE APPARATUS AND SYSTEM FOR STATIONARY USERS

(71) Applicant: Baruch Markowitz, Monroe, NY (US)

(72) Inventor: Baruch Markowitz, Monroe, NY (US)

( * ) Notice: Subject to any disclaimer, the term of this patent is extended or adjusted under 35 U.S.C. 154(b) by 275 days.

(21) Appl. No.: 14/306,696

(22) Filed: Jun. 17, 2014

(65) Prior Publication Data

US 2014/0371038 A1 Dec. 18, 2014

Related U.S. Application Data

(60) Provisional application No. 61/836,087, filed on Jun. 17, 2013, provisional application No. 61/927,930, filed on Jan. 15, 2014.

(51) Int. Cl.

| | |
|---|---|
| ***A63B 21/00*** | (2006.01) |
| ***A63B 21/04*** | (2006.01) |
| ***A63B 71/00*** | (2006.01) |
| ***A61H 3/04*** | (2006.01) |
| ***A63B 21/055*** | (2006.01) |
| ***A63B 21/28*** | (2006.01) |

(Continued)

(52) U.S. Cl.

CPC ..... *A63B 21/0442* (2013.01); *A61H 3/04* (2013.01); *A63B 21/00065* (2013.01); *A63B 21/00185* (2013.01); *A63B 21/0414* (2013.01); *A63B 21/055* (2013.01); *A63B 21/0557* (2013.01); *A63B 21/28* (2013.01); *A63B 21/4023* (2015.10); *A63B 21/4033* (2015.10); *A63B 21/4035* (2015.10); *A63B 21/4045* (2015.10); *A63B 22/20* (2013.01); *A63B 22/203* (2013.01); *A63B 23/03508* (2013.01); *A63B 23/03516* (2013.01); *A63B 23/03583* (2013.01); *A63B 71/0009* (2013.01); *A61H 2003/004* (2013.01); *A61H 2003/046* (2013.01); *A63B 22/0023* (2013.01); *A63B 2022/0094* (2013.01); *A63B 2208/0233* (2013.01); *A63B 2208/0252* (2013.01); *A63B 2210/50* (2013.01)

(58) Field of Classification Search

CPC ..... A63B 21/00
USPC ..... 482/142, 130, 907
See application file for complete search history.

(56) References Cited

U.S. PATENT DOCUMENTS

| | | | |
|---|---|---|---|
| 4,765,614 | A | 8/1988 | Shute |
| 6,117,056 | A | 9/2000 | Cataldi, Jr. et al. |

(Continued)

FOREIGN PATENT DOCUMENTS

| | | |
|---|---|---|
| CN | 201832055 | 5/2011 |
| DE | 20014378 | 10/2000 |

(Continued)

OTHER PUBLICATIONS

Product: Wheelchair Workout. Found at http://www.colonialmedical.com/wheelchair-workout-P-7192.html. Accessed Nov. 21, 2013.

(Continued)

*Primary Examiner* — Jerome W Donnelly
(74) *Attorney, Agent, or Firm* — Calhelha & Doyle LLC

(57) ABSTRACT

Exercise equipment, particularly a linear movable structure and associated selectable elastic resistance bands with or without guide track members are designed to allow low-impact exercises for one or two persons at the same time while permitting either or both participants to remain stationary when utilizing the equipment.

16 Claims, 8 Drawing Sheets

(51) Int. Cl.

| | |
|---|---|
| ***A63B 22/20*** | (2006.01) |
| ***A63B 23/035*** | (2006.01) |
| *A63B 22/00* | (2006.01) |
| *A61H 3/00* | (2006.01) |

(56) References Cited

U.S. PATENT DOCUMENTS

| | | | | |
|---|---|---|---|---|
| 6,338,354 | B1 | 1/2002 | Alexander | |
| 7,066,868 | B2 | 6/2006 | Van Den Heever | |
| 7,094,188 | B2 | 8/2006 | Reitz et al. | |
| 7,569,002 | B2 | 8/2009 | Nativ | |
| 7,798,943 | B1 | 9/2010 | Tsai | |
| 7,955,238 | B2 | 6/2011 | Dokshutsky | |
| 8,021,273 | B2 * | 9/2011 | Kopp | A63B 1/00 297/281 |
| 2002/0169058 | A1 * | 11/2002 | Harmon | A63B 21/0023 482/142 |
| 2005/0250628 | A1 | 11/2005 | Goldstein | |
| 2006/0003877 | A1 * | 1/2006 | Harmon | A63B 21/0023 482/142 |
| 2012/0048318 | A1 | 3/2012 | Zendzian et al. | |

FOREIGN PATENT DOCUMENTS

| | | |
|---|---|---|
| GR | 1003252 | 11/1999 |
| WO | 2010133731 | 11/2010 |

OTHER PUBLICATIONS

Product: Wheelchair Universal Elastic Strap. Found at http://www.healthandcare.co.uk/wheelchair-belts/wheelchair-universal-elastic-strap.html. Accessed Nov. 21, 2013.

Products: Up n' Go, Up n' free, and Up n' Tread Gait Trainers by Easy Walking Inc. Found at http://www.easy-walking.com/. Accessed Sep. 24, 2015.

International Search report and Written Opinion in corresponding PCT Application, International Application No. PCT/US2014/042727 mailed Dec. 30, 2015.

* cited by examiner

EXERCISE APPARATUS AND SYSTEM FOR STATIONARY USERS

CROSS-REFERENCE TO RELATED APPLICATIONS

This application claims the benefit of provisional application Ser. No. 61/836,087 filed Jun. 17, 2013 and provisional application Ser. No. 61/927,930 filed Jan. 15, 2014 which are both incorporated herein by reference.

FIELD OF THE INVENTION

The current invention relates to the field of exercise equipment, more specifically to a linearly movable structure and associated resistance bands designed to allow low-impact exercises while a person remains in a stationary position.

BACKGROUND OF THE INVENTION

Many people who could benefit from a low-impact exercise routine are unable to do so due to lack of mobility. Such persons include the elderly, or those who have suffered an injury or some incapacity, or persons recovering from surgery. There is a need for a multipurpose gym apparatus that can be used in a variety of clinical and home settings where the principal user remains stationary, e.g. where the user is seated. Further it will be advantageous to provide a device that can effortlessly be adjusted to accommodate varying levels of exercise intensity.

It is therefore advantageous to provide an exercise or therapy apparatus that can be readily utilized by a stationary person. Such stationary exercises will generally be accomplished while the participant is seated, but the subject apparatus can be readily adapted to benefit a bedridden person as well.

There is provided herein an exercise apparatus and system which will also benefit a person who has lower extremity dependent edema or a person at risk of deep vein thrombosis. It can also be used for strengthening and endurance exercises. Multiple levels of resistance allow patients to build both upper and lower extremity strength, core strength and endurance while safely sitting in their chair.

Among the benefits provided to a stationary participant by the subject apparatus are low impact exercise, stress relief, stretching of legs or arms to improve mobility and range of motion, all while developing strength. Breathing, aerobic and lung improvements are also contemplated as well as increased cardio-vascular activity and endurance.

The subject apparatus can provide a low impact workout operating on upper and lower extremities at the same time if desired. A variety of active and passive Range of Motion exercises can be incorporated into a workout routine with the subject equipment.

Furthermore, the apparatus allows a therapist to easily convey simple instructions to less capable users, generally just push, or pull. Regular rhythmic activity can often benefit dementia patients, serving to increase their interests. For other patients, simple resistance bouncing of the legs may provide proprioceptive benefits whereby the motion and pressure feedback can give positive and useful feedback to one's muscles and joints. For other patients, increased activities may serve to decrease incidence of bedsores.

Use of the subject device also may be seen as motivational. Sensory stimuli from movement and exercise can improve focus and concentration for some patients. Even a sitting patient can fully participate.

The apparatus is particularly suitable for two people to use at once, participating together at the same time in a dual action mode, either helping or just entertaining each other. The device is especially suitable for physical therapists, occupational therapists, fitness professionals and persons that simply want to become more active.

Many users of this device will already be suffering from limited mobility, for any number of reasons. This apparatus allows them to have some physical activity, making them feel better physically by strength and stretch training, and also mentally as they improve physically. Moods will improve and users of this device will feel good and happy.

Some people resent physical therapy and being told what exercises they should do, particularly older people in nursing homes with little control over their daily routines. The subject apparatus provides a variety of different possible exercises, and can be utilized with or without guidance. The user can feel independent by deciding how to use the apparatus, providing a sense of accomplishment and control.

Another advantage to this design is that many people with many different capabilities or limitations can all use the same apparatus. It may be operated by someone who uses one or both hands only, or it may be operated by someone who uses one or both legs only.

Further, the apparatus provides a wide variety of activities and intensities. As the apparatus is manually controlled, it is easy for a user to switch activities or vary the intensity of the activity. This way the user may avoid fatigue, and can rest one part of the body while still exercising another.

The apparatus may serve as a warm-up activity before the user goes on to perform other more strenuous exercises. For most users, though, no overly strenuous exercises need be experienced, and the exercises performed with the subject apparatus will satisfy all their activity needs.

For those requiring assistance, someone else, perhaps a physical therapist, a friend, a volunteer, or loved one can simply place the user's hands or feet on the device, and can move the apparatus back and forth, or move the patient's legs up and down as in marching, thereby facilitating the exercise needed. The helper likewise receives some beneficial exercise while assisting the other person.

The typical intended audience for the subject device and method are relatively inactive, sedentary or less capable people who are not usually able to perform physical activity. Regular use of the subject exercise apparatus can therefore help maintain general physical and functional well being. As such, it may help strengthen some muscles, expand the lungs, protect the joints, improve balance and range of motion, assist in burning calories, thereby contributing to weight loss, lower blood sugar, lower cholesterol count, improve circulation, improve mood, and reduce stress. It may also help improve bowel movements, through muscle and tissue use, and may tend to improve bladder control problems. If desired, the user can achieve the cardiovascular benefits of an aerobic workout, while strengthening muscles in the trunk, arms and legs. Such a workout tends to increase the user's appetite, as well as respiration, focus and concentration.

SUMMARY OF THE INVENTION

The invention described herein is an exercise apparatus that allows users to perform upper and lower body exercises while in a stationary position, which is typically a seated position. The subject exercise and therapy apparatus enables a stationary user to engage elastic resistance elements and a linearly movable frame for forward and reverse linear reaching and retrieving motions.

The apparatus has a linearly movable frame with at least two substantially parallel vertical posts, where each of the vertical posts has an upper aspect and a lower aspect. A plurality of linear movement mechanisms, preferably fixed wheels, are attached to the frame for movement in a substantially straight line.

At least one elastic resistance member is mechanically attached substantially horizontally to respective lower aspects of the at least two vertical posts, the elastic resistance member urges movement of the apparatus along the substantially straight line when stretched by a user.

The frame is thereby configured to engage a stationary user relatively within a portion of the frame and permits forward and reverse linear reaching and retrieving motions by the user.

In preferred embodiments, the at least one elastic resistance member is a lower elastic resistance member mechanically attached horizontally to the frame in front of the user's legs and configured to engage the user's feet or legs in a forward and reverse linear elastic resistance fashion. The elastic resistance member may incorporate a plurality of elastic bands configured to facilitate selection of different resistance strengths by the user. The lower elastic resistance member is particularly useful for user leg stretching or bouncing motions.

The apparatus may also have a horizontal support bar attached at each end to opposite sides of the vertical posts of the frame and parallel to the lower elastic resistance member and which is configured for use by a second user to oppose the linear motion of the first participant.

In another embodiment, the apparatus may have at least one upper elastic resistance member attached substantially horizontally to respective upper aspects of the vertical posts of the frame in front of the user's torso and which is configured to engage and resist the user's hands or arms in a forward and reverse linear fashion. The upper elastic member is suitable for user stretching, bouncing and gripping motions. It may be configured with a plurality of elastic resistance straps which can be selected by a user for variable resistance strength or the resistance bands may be shared with another user for multiple person participation.

In another embodiment, a plurality of fixed wheels may be configured to engage a linear guide track. Preferably, each vertical post of the moveable frame has at least one wheel. The wheels may be oriented offset from a longitudinal axis of the vertical posts for additional stability. A variety of wheel configurations may be utilized with the frame so long as these facilitate linear motion. Examples include wheels paired with a second tandem or side-by-side stabilizing wheel.

The apparatus may further comprise an optional hand gripping member for strengthening user's hands and facilitating stretching and extension of user's arms. Preferably, the hand gripping member is a rotatable or squeezable grip element. Additional grips may be attached to arm stretching extension members such as measured rods elastically attached to the frame for resistance.

As mentioned above, some embodiments of the subject apparatus may incorporate at least one track for guiding the apparatus on a fixed linear path upon a surface. Preferably in such embodiments, a plurality of parallel tracks will be utilized. The tracks support the moveable frame apparatus and are configured to guide each of the frame wheels on a fixed linear path.

Optionally, the tracks may incorporate a vertical adjustment to incline the track.

In another embodiment, an exercise apparatus comprises: a linearly movable frame having at least two substantially parallel vertical posts, each of the vertical posts having an upper aspect and a lower aspect; at least one elastic resistance member mechanically attached substantially horizontally to respective lower aspects of the at least two vertical posts, the elastic resistance member urging movement of the apparatus along the substantially straight line when stretched by a user, wherein the frame is configured to engage a stationary user relatively within a portion of the frame and thereby permitting forward and reverse motions of the apparatus; and a linear movement mechanism, the linear movement mechanism selected from the group consisting of a linear guide track, the linear guide track engaging with a bottom of the frame; ball bearings, the ball bearings engaging with a bottom of the frame; plastic glide pads engaging with a complementary low friction surface of a guide track; and a linear rack gear, the linear rack gear engaging with a pinion gear on the frame.

A method of exercise or therapy for one or more participants comprises the steps of engaging at least one stationary participant relatively within a linearly movable frame having a plurality of fixed wheels for movement in a straight line and at least one elastic resistance member for urging movement of the apparatus along the straight line; grasping or pushing the elastic resistance member thereby urging movement of the frame and simultaneously opposing such motion thereby permitting resisted forward and reverse linear stretching, reaching and retrieving motions.

Another advantage to this design is that during some exercises where a user pulls the apparatus close to his body, the open design allows the user's knees or legs to protrude through the device and beyond the frame as necessary.

Another advantage is that the apparatus can be operated very quietly and can be readily operated in a hospital room or nursing home without disturbing a patient's roommate.

The apparatus is also portable, and may be used anywhere, including outside or on grass. To facilitate the portability of the device, the sides may be folded inwards and the device rolls on its forward wheels. When not in use, it can easily be folded up and stored away.

Exercises using flexion and extension, pushing feet up and down using the resistance of the natural rubber resistance bands can emulate a marching rhythm. The user's legs can be spread out, or positioned together, for greater leg and abdominal muscular development. Posture and back straightening can be easily improved with the subject apparatus.

Other objects, features and advantages of the present invention will be apparent when the detailed descriptions of the preferred embodiments of the invention are considered with reference to the accompanying drawings, which should be construed in an illustrative and not limiting sense as follows.

DETAILED DESCRIPTION OF THE PREFERRED EMBODIMENTS

The subject improved apparatus has several important elements as detailed herein below. Connections among elements may include physical and mechanical fasteners and connectors, or integrally attached or bonded components. In preferred embodiments, the frame may be made of ¾ inch (1.9 cm) tubular steel, welded at joining connections, elbows or t-joints, or are mechanically affixed with bolts, snaps, clips or the like. Other materials are possible including molded or extruded plastics having sufficient strength and durability for the intended application. Reinforced thermoplastics may also be utilized as well as other metals, such as aluminum.

Embodiments of the present invention will now be described with reference to the above-identified figures. However, the drawings and the description herein of the invention are not intended to limit the scope of the invention. It will be understood that various modifications of the present description of the invention are possible without departing from the spirit of the invention. Also, features or steps described herein may be omitted, additional steps or features may be included, and/or features or steps described herein may be combined in a manner different from the specific combinations recited herein without departing from the spirit of the invention, all as understood by those of skill in the art.

A user may sit in virtually any chair that he desires to perform the exercises described herein. Moreover, the frame that supports the resistance bands described herein is linearly movable allowing a user to sit in a place that is comfortable and the frame may be brought to him.

For convenience, a typical user of the apparatus is sometimes called the patient, or first participant, particularly when a second person is participating or facilitating use of the device. It is understood that such user may merely be utilizing the device for exercise, fun or engagement with other users. It is also understood that for convenience the masculine pronouns and possessive adjectives are used but the user, patient, therapist or participant may be male or female.

Figure 1:
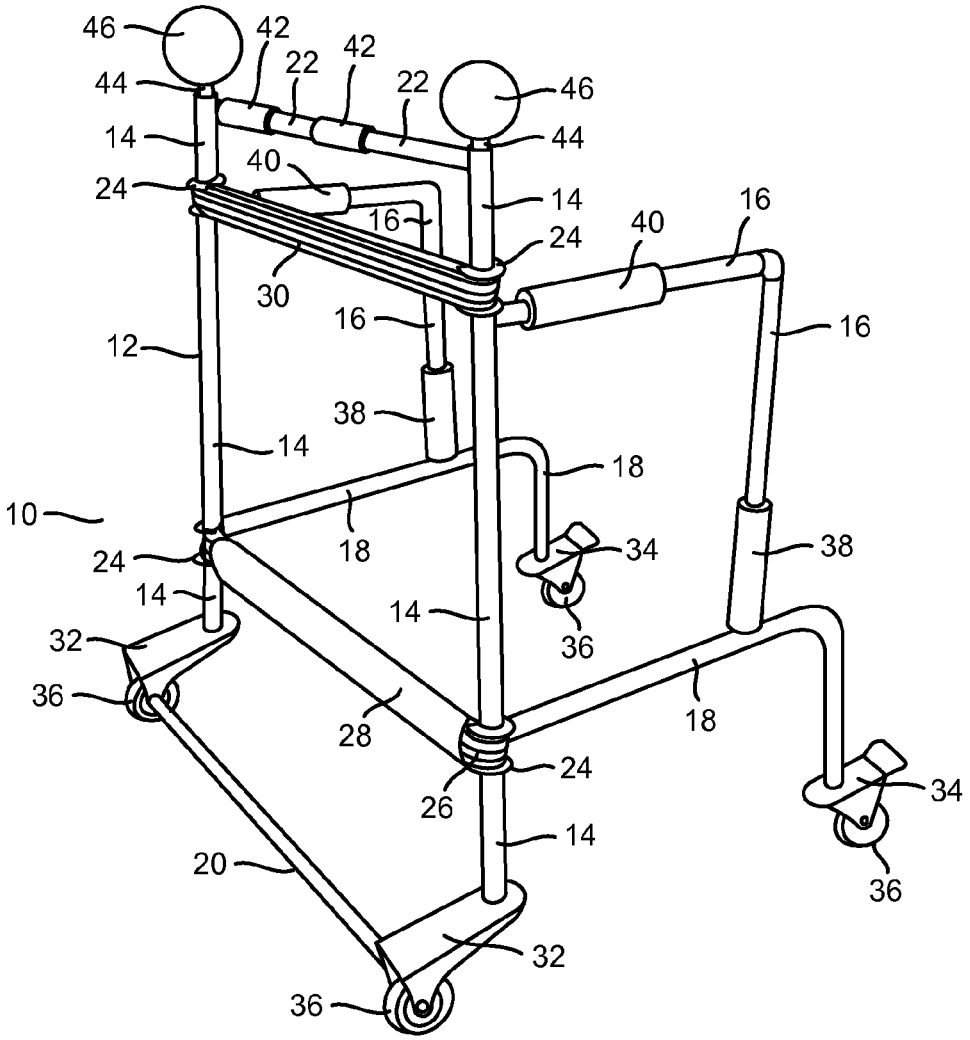
FIG. 1 is a perspective view of the subject exercise and therapy apparatus.

FIG. 1 is a perspective view of one embodiment of the subject system. The exercise and therapy apparatus 10 is a portable frame 12 that has at least two parallel upward oriented front vertical support frame posts 14. The front or forward vertical posts 14 run substantially from just above the floor level and rise upwardly. At least one upper resistance band 30, is secured between the two bars, substantially orthogonally to the bars. In preferred embodiments, there are three loops of resistance bands, allowing a user to grip any number of bands from one to six. The variations in resistance will be changed manually as a user chooses how many upper resistance bands 30 to grip during exercise. The upper resistance bands 30 will be secured in position on the forward vertical frame posts 14 by a pair of spools 24, one on each vertical post 14. A second set of lower resistance bands 26 may be secured toward the bottom of the frame to allow a user to place his feet thereon. The lower resistance bands 26 are also held in position by a pair of spools 24. In a preferred embodiment, to protect the lower resistance bands 26 from damage and wear from a user's feet, and also to protect the user from getting his feet entangled by the lower resistance bands 26, the lower resistance bands will be wrapped in a heavy duty canvas or nylon fabric cover 28. A cover is less useful for the upper bands, particularly when a plurality of bands are installed on the frame and a user or therapist desires to grasp less than all the available bands, to provide less strenuous resistance.

In preferred embodiments the upper resistance bands 30 are made of natural rubber of standard strength, though a variety of elastic fabrics, tension bands or flexible ropes may be used. Natural rubber resistance bands are typically preferred because of ease of use, economy and satisfactory performance in the subject applications. Lengths of rubber tubing can be joined with plastic plugs and friction to provide suitable O-ring resistance bands. Other materials such as resistance strapping or elastomeric webs, springs or shock cord may be utilized where desired. Spools 24 are preferred for maintaining the position of the set of resistance bands 30 and 26 though other methods of securing resistance bands in position can utilize hooks, clasp and rings at either end of the outstretched resistance members. Combinations of these may offer advantages in some applications.

In some embodiments, the resistance bands may be adjustable to higher or lower positions on the vertical frame posts. For example, in one embodiment, respective spools for securing bands to posts are movable along longitudinal axes of respective posts. The spools may be movable using any of various mechanisms as would be understood by those of ordinary skill in the art. In one example, spools are secured around shafts of posts in a tight frictional grip. Such frictional grip may be overcome by a user to force the spool upward or downward (with respect to the floor) as desired. Alternatively, spools may be provided with a spring biased pin that inserts into various holes provided along the length of respective posts. In other embodiment, additional sets of resistance bands bay be positioned on the vertical frame posts so that users have a choice of which set to use for a desired exercise.

The forward vertical posts 14 terminate at the floor with a front wheel housing 32. Within each wheel housing 32, set forward of the forward vertical posts 14, a wheel 36 is installed in a straight orientation. The wheel 36 is installed in a fixed direction that permits rotation only in a linear direction, such that the apparatus rolls only forwards and backwards with no sideways motion.

Between the wheel housings 32, a front horizontal support rod 20 is installed to maintain the shape and structure of the frame apparatus 10. It will be seen later that the lower front horizontal support rod 20 may be used to assist in a number of exemplary exercises and provides a convenient point of leverage or resistance for a therapist or second user operating in front of the patient. Also providing support to the shape and structure of the frame apparatus 10 is an upper front horizontal support rod 22. On the upper horizontal support rod 22 there are two tubular grips 42 that a user may use to grasp the frame 10 when doing exercises. The tubular grips will have an inside diameter just slightly larger than the outer diameter of the frame so that the tubular grips 42 will be able to slide along the upper horizontal support rod 22 permitting a user to change the angle of his exercise by moving his hands closer together or farther apart. Also, the user may exercise or stretch his arms and wrists by rotating the grips 42 around the upper horizontal support rod 22. The tubular grips 42 may be made of wood, plastic or any material suitable for sliding along and around the upper horizontal support rod 22.

The exercise and therapy apparatus 10 also has a set of side frame members on each side 16, 18. Upper side frame posts 16 are attached orthogonally to forward vertical posts 14, and continue rearward horizontally and substantially parallel to the floor, before bending 90 degrees towards the floor and connecting to lower side frame members 18. Lower side frame members 18 are attached orthogonally to forward vertical posts 14, and continue rearward horizontally and substantially parallel to the floor, before bending 90 degrees towards the floor and terminating in a rear wheel housing with optional brake 34. Optional wheel brakes may be utilized to stabilize the frame. Additionally, such brakes may be useful if a standing patient desires to use the device with one foot on the floor and the other foot on either the frame or lower strap.

Wheels 36 are installed in wheel housings 34 in a fixed orientation to prevent sideways motion and maintain the strict forward and backward motion of the apparatus. It is preferred to utilize four fixed wheels 36 in the subject apparatus, for stability and to ensure straight back and forth motion. More or fewer wheels are possible but are less preferred as they may become cumbersome or less effective. Fixed wheels are preferred over swivel wheels for the same reasons. Unless utilized with a guide rail as discussed in more detail below, swivel wheels may detract from the stability of the device, particularly for users who may have limited strength and motion capabilities.

The upper side frame posts 16 may also have tubular grips installed thereon. In the pictured embodiment, the horizontal section of the upper side frame post 16 has a pair of grips 40 installed that may move forward and backward along the side member. In addition, a pair of grips 38 is installed on the vertical section of the upper side frame posts 16, to facilitate an upwards and downwards motion for exercise activity. In preferred embodiments, each of the tubular grips 38, 40, and 42 can be stored out of position as desired and a user can instead merely grasp the frame post itself. In another embodiment, instead of the tubular sliding grips 40 and 38, a foam or rubberized padding is wrapped around the side frame posts, providing a stable and comfortable area for gripping the apparatus.

A further feature of this exercise and therapy apparatus 10 are the extension rods 44 that are installed within each forward vertical frame posts 14. At the top of each extension rod 44 is a spherical rubber ball 46 for gripping the top of the extension rod 44 during arm extension exercises. In preferred embodiments, the stopper at the top of the extension rod will be a spherical rubber ball, however any easily graspable stopper may be used. Further details are given in connection with FIG. 3 below.

Figure 2:
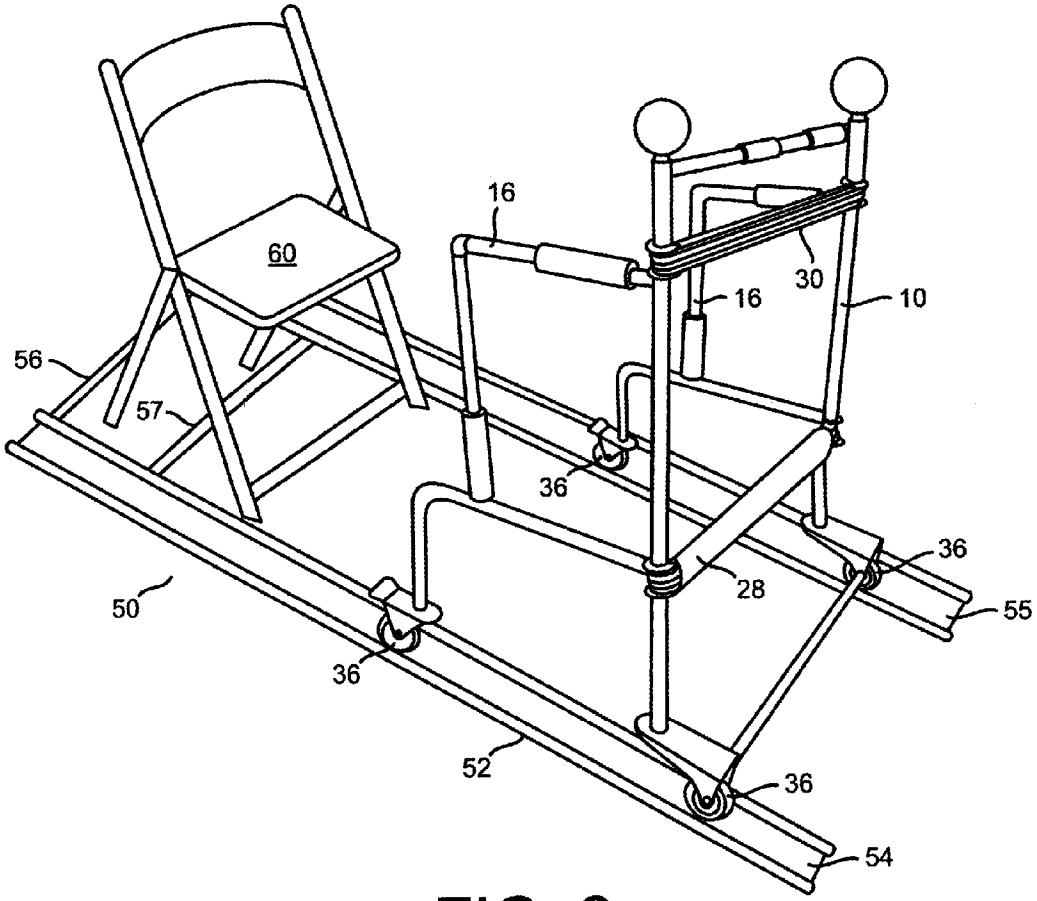
FIG. 2 is a perspective view of an alternative embodiment of the subject system.

FIG. 2 is a perspective view of the subject exercise and therapy apparatus and system 50 utilizing a guide rail. In this embodiment, the assembly 10 of FIG. 1 has been deployed upon a guide track 52 for a user sitting in chair 60. The track assembly 52 comprises a right track 54 and a left track 55 that are parallel to each other and lay along the floor. In this embodiment, each track is a substantially flat length of material which has raised walls on either side thereof. The two parallel tracks 54 and 55 are mechanically connected to each other by a pair of rods 56 and 57. The connections are typically made of bolts or welds. Rods 56 and 57 are parallel to each other, and each perpendicular to both tracks 54 and 55, forming a stable and fixed parallel track for the apparatus 10 to cooperate with. The apparatus 10 is installed on the frame by placing the wheels 36 in the tracks 54 and 55. The user then may sit in chair 60, at one end of the track assembly 52, and roll the exercise and therapy apparatus forwards and backwards within the tracks. It will be recognized that the chair 60 is used for illustration only, and any style of stationary seat or position would allow a user to use the system without departing from the scope of this disclosure.

It will be recognized that the track can be fabricated from other durable materials such as wood. For a permanent installation, guide rails could be built into the floor of a rehabilitation facility.

As an alternative, the track may be placed on a high-density foam or rubber mat that will provide traction for the track, as well as the user's chair. In the preferred embodiment, the track will have a foam or rubberized coating so that it may be placed on any floor surface and resist slipping. In that preferred embodiment, it may be desirable to place a rubber mat below the user's chair to prevent the chair from sliding during exercise.

The add-on track accessory described above provides a significant new functionality to the subject exercise apparatus. Foremost, it guides the user within a limited path, which is useful for some users based upon their personal capabilities. Further, the front or rear of the track frame can be raised on an incline to provide either an uphill or downhill experience for the user. Alternatively, the track itself may have an ascending aspect such as a slight ramp. A modest incline of just a few degrees can add to the intensity and vigor of a particular workout regimen.

Optional measurements indicated along the track can be used to record performance improvements for the user. For safety purposes, it is contemplated that a therapist would assist a user of the apparatus when an inclined track is in use. Benefits of the track system include safe, straight operation. It is contemplated that sight-impaired individuals can safely utilize the apparatus configured with the track and rail accessory.

Figure 3:
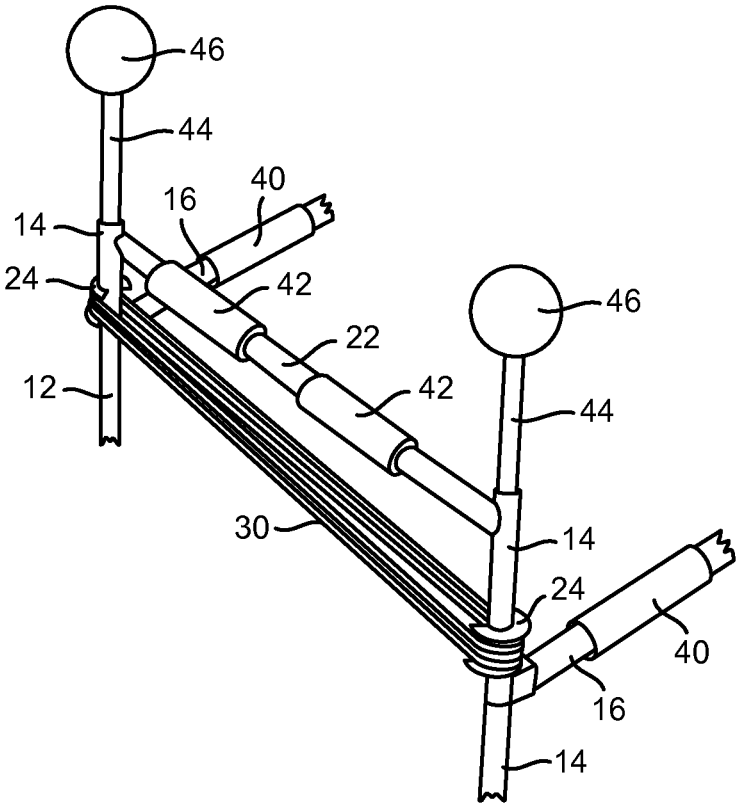
FIG. 3 is a perspective view of a portion of the subject apparatus.

FIG. 3 is a perspective view of the upper portion or aspect of the apparatus. In this view, extension rods 44 are extended out of the forward vertical posts 14. The extension rods 44 may be used for arm lifting and extending exercises. In preferred embodiments the extension rods 44 is affixed to the inside bottom of the forward vertical bar 14 housing with a resistance band which will provide additional resistance. The extension rods can have gradations measured along its length and a therapist or user can readily determine progress and whether both arms are lifting comparably, or one is better than the other. Furthermore, if measurements are recorded, a therapist can track improvements in lifting ability or range of arm motion over time. It should be recognized that range of motion improvements of this type may facilitate muscle development and lung function improvements.

Similarly, an interested therapist or user could optionally attach a weight or force measuring device, such as a spring-operated scale, to the upper or lower resistance bands. This affords the opportunity to obtain a baseline and track improvements of the patient's use of the machine in a variety of its resistance modes.

Figure 4:
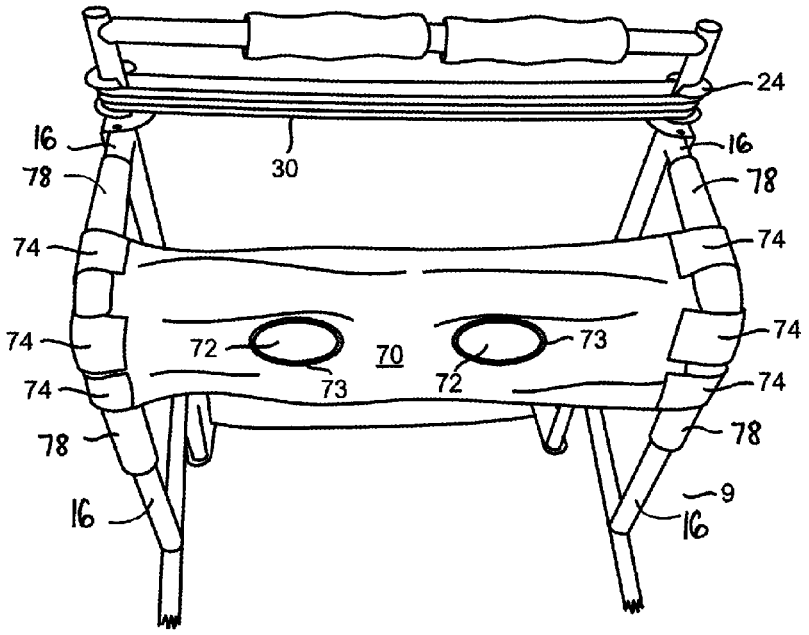
FIG. 4 is a perspective view of a portion of the subject apparatus showing an additional optional feature.

FIG. 4 shows a perspective view of the upper portion 9 of the assembly of FIG. 1 having an additional optional feature. In this view, the optional arm sling 70 is shown as installed on the upper side frame posts 16. The arm sling feature may be used by any user, but it will be particularly helpful for users who are weakened due to age, illness or injury and need assistance to support the weight of their arms and upper body when performing upper body exercises. The arm sling 70 is an elongated sheet of material or fabric and it has a pair of holes 72 through which a user may pass his hands and arms before reaching forward to grip the resistance bands 30. The holes 72 are reinforced with stitching 73 to prevent rips or tears during use. The user may pass his arms through the holes 72 so that his wrists are supported by the sling, or even further through the sling so that the sling supports the user's chest. The sling is removably attached to the upper side frame posts 16 by a series of hook and loop fabric closures, which will be seen more clearly in the next figure. This view also shows the alternative foam or rubber grips 78 that may be used for comfort on the upper side frame posts 16, instead of the slidable tubular handles seen in FIG. 1. Additionally, the arm sling can function as a safety device since when a user's hands are through the holes 72, the apparatus 10 is arrested from rolling away from the user and into the therapist or out of reach if the user lets go of the bands, grips or frame.

Figure 5:
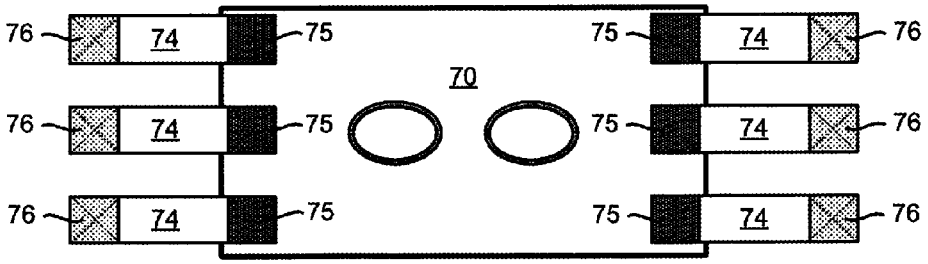
FIG. 5 is a plan view of an optional additional accessory for the apparatus.

FIG. 5 is a plan view of the optional arm sling 70 as shown in FIG. 4. In preferred embodiments, the sling is made of a strong fabric such as canvas or nylon. In one embodiment, at each end of the sling, there is at least one strip 74 of fabric having corresponding hook and loop closure patches 75, 76 at opposite ends of the strip 74 such that the strip 74 may be wrapped around the frame and attached to itself to secure the sling 70 to the frame. In other embodiments more strips may be used, and a variety of closure mechanisms may be used, such as snaps, buckles, clips, adhesive and the like.

Figure 6:
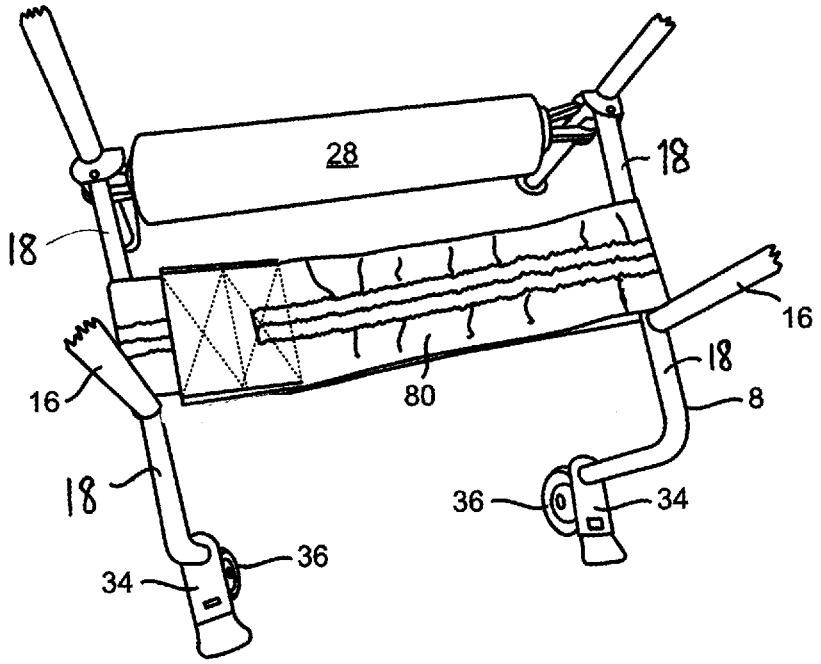
FIG. 6 is a perspective view of a portion of the subject apparatus showing an alternative additional optional feature.

FIG. 6 shows a perspective view of the lower aspect 8 of the assembly of FIG. 1 having an additional optional feature. In this view, an optional leg sling 80 is shown as installed on the lower side frame posts 18. The leg sling feature may be used by any user, but it will be particularly helpful for users who are weakened due to age, illness or injury and need assistance to support the weight of their legs when performing lower body exercises. In between exercises the sling is useful for resting the legs.

Figure 7:
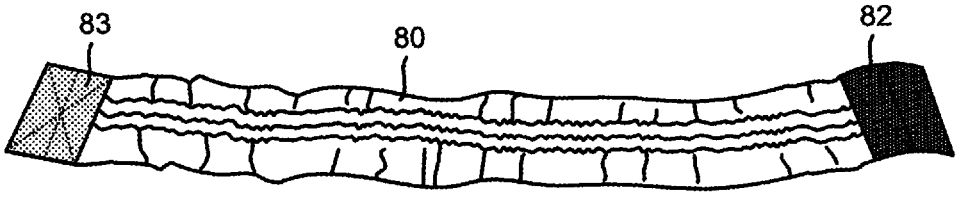
FIG. 7 is a perspective view of an optional additional accessory for the apparatus.

FIG. 7 shows a perspective view of the template for the leg sling 80 as shown on the apparatus 8 in FIG. 6. In one embodiment, at one end of the sling 80 there is a fabric hook and loop patch 83 while at the opposite end of the sling 80 is a corresponding fabric hook and loop patch 82. In this configuration, the sling may be wrapped around the horizontal portion of the lower side frame posts 18, and then hook and loop clasped to itself, forming a loop of fabric held in a horizontal orientation by the lower side frame members. It will be recognized that other closure mechanisms may be used, such as snaps, buckles, clips, adhesive and the like.

An additional benefit of the leg sling will be recognized by therapists who work with patients having dementia. If the patient is stationary in a chair and has his legs resting on the sling, he is discouraged from getting up to wander away while the therapist helps another patient.

Some preferred embodiments will incorporate a foldable frame. Other embodiments can incorporate quick connectors, such as spring or snap buttons or toggles for easy assembly and disassembly. The present apparatus can be readily moved by tilting the frame forward on its front wheels and moving the device to another location.

Figure 8:
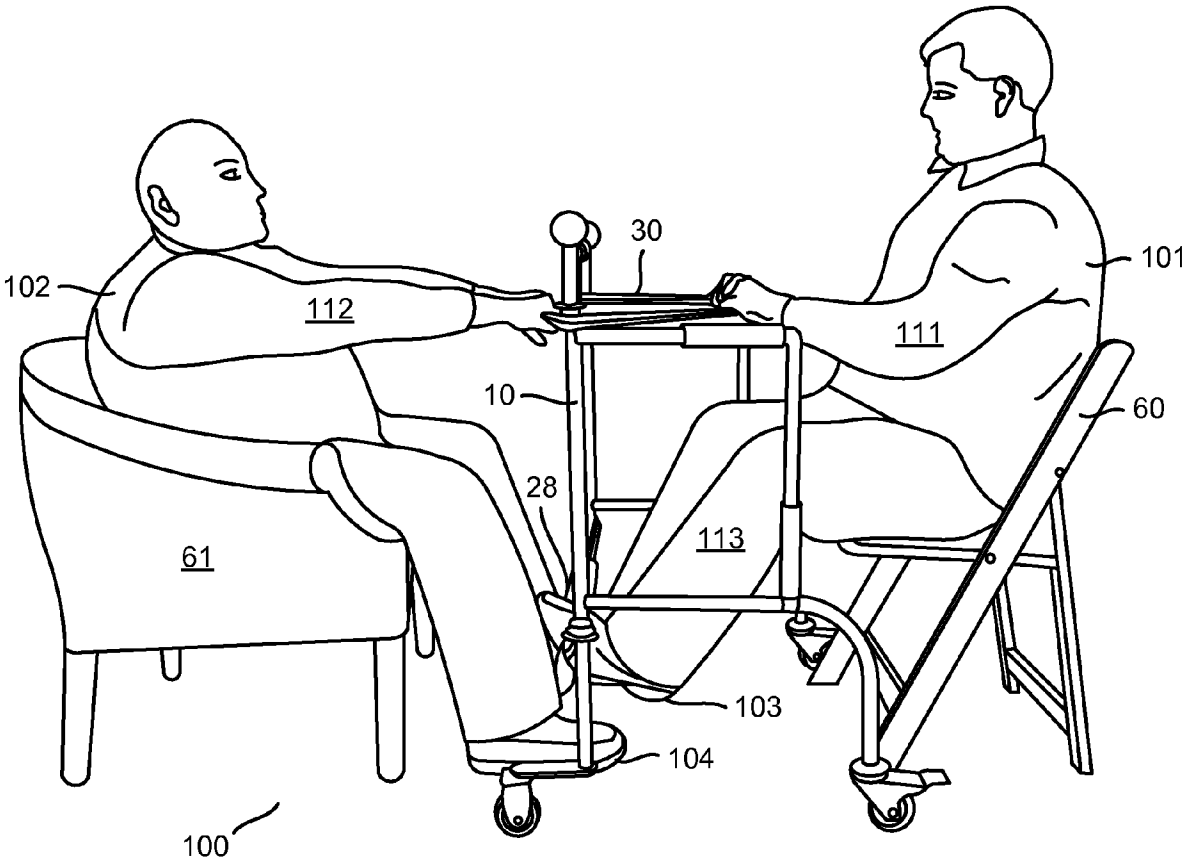
FIG. 8 is an elevation view of two participants using the subject apparatus of FIG. 1 for one possible example exercise.

FIG. 8 is an elevation view of two participants using the subject apparatus 10 of FIG. 1 for one possible example exercise 100. In this exercise, the patient 101, or Participant A, is stationary and sitting in a chair 60. The patient 101 has his feet 103 placed on the lower resistance band 28 and is grasping the upper resistance bands 30 and with arms 111 bent pulls one or more resistance bands, which consequently pulls the apparatus 10 towards himself. The user may also use his feet (resting on the lower band) or a combination of hands and feet to pull the apparatus 10 towards himself. Optionally, the therapist 102, or User B who could be a friend, caretaker or even another patient, places his feet 104 on the lower front horizontal support rod 20 to provide stability and tension to the apparatus while extending his arms 112 to allow the patient 101 to pull the apparatus 10 toward himself. Typically the therapist 102 will also be sitting in a chair 61, though he will be able to assist the patient 101 from many other positions including standing.

Figure 9:
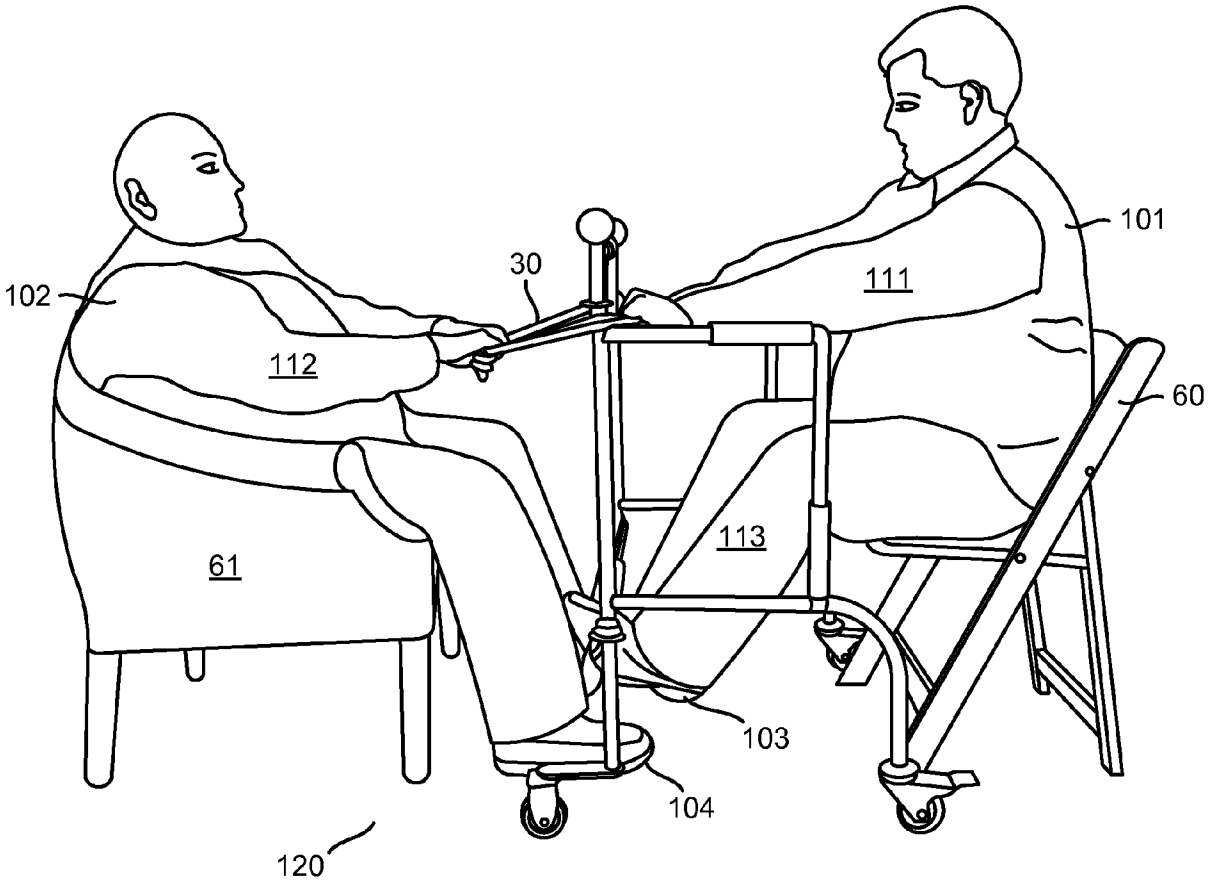
FIG. 9 is an elevation view of two participants using the subject apparatus of FIG. 1, as in FIG. 8 in a subsequent step of the example exercise.

FIG. 9 is an elevation view of the two participants 101, 102 using the subject apparatus 10 of FIG. 1, as in FIG. 8 in a subsequent step 120 of the example exercise. Here, the patient 101 has his legs 113 elevated and feet 103 on the leg resistance band 28 while he continues to grasp the upper resistance bands 30 and extend his arms 111 while pulling back to resist the pull of the therapist 102, as the apparatus 10 rolls away from the patient 101.

Figure 10:
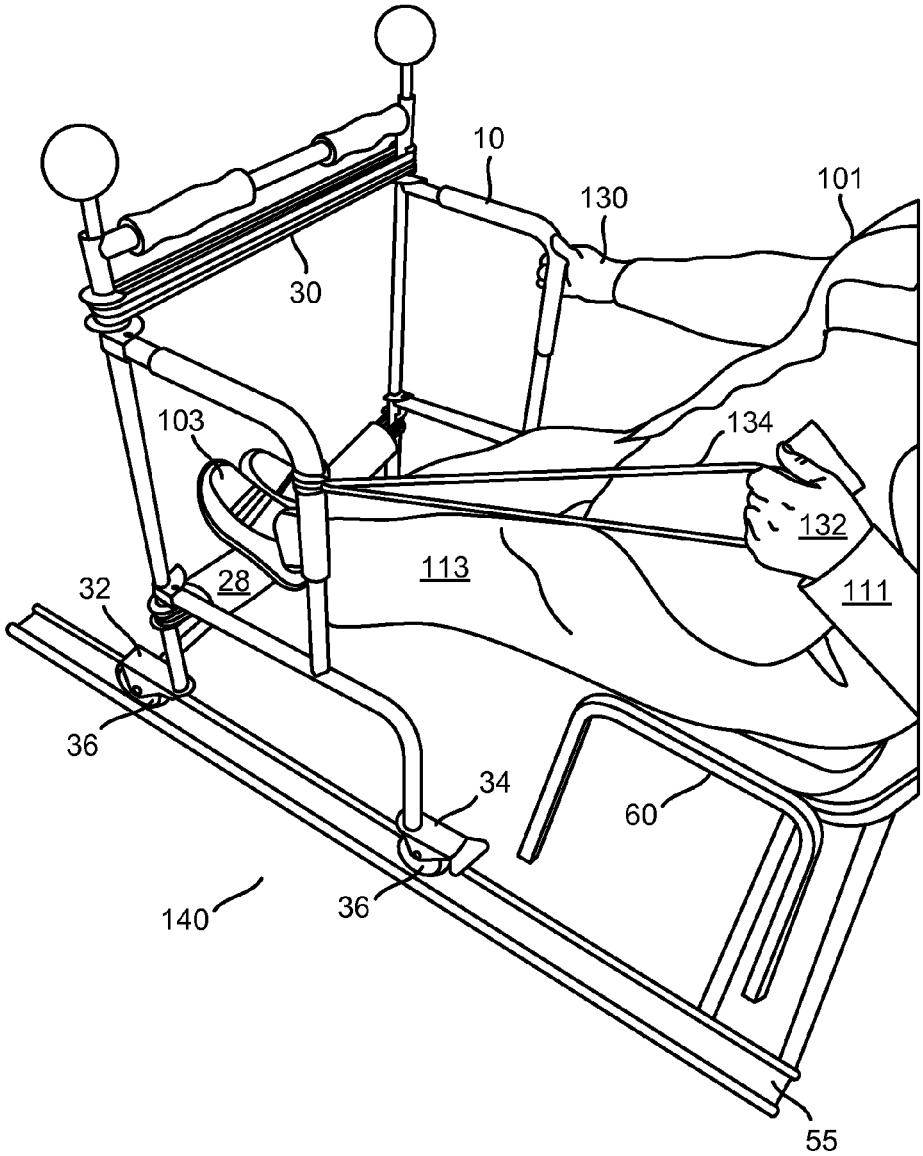
FIG. 10 is a perspective view of the subject system showing an additional optional accessory and example exercise.

FIG. 10 is a perspective view of the subject system 140 showing an additional optional accessory 134 and another example exercise. In this embodiment, a resistance band is attached substantially parallel to an upward post (e.g. 16) of the frame. The band so attached may be used in the following example exercise: the patient 101 is stationary in a chair 60, rests his feet 103 on the lower resistance bands 28 and stretches and extends his legs 113 so that the apparatus 10 is pushed away from him. He stabilizes the apparatus 10 with his right hand 130 by gripping the right side of the apparatus, while gripping the optional resistance band 134 in his left hand 132. The patient 101 bends his arm 111 to perform arm stretches and exercises. The patient may also pull the band toward himself—thereby stretching the band and then return the band to its unstretched default position. It is notable that this is an example of an exercise in which the patient 101 is the sole participant. This Figure is also showing an example of an exercise performed while the apparatus 10 is set within the track which maintains the linear directionality of the movement of the apparatus, even when a participant is pulling on only one side.

An apparatus was constructed in accordance with the subject disclosure and had the following dimensions:

A tubular steel frame having an outer width of approximately 26.5 inches (67.3 cm), a depth of approximately 24.5 inches (61.3 cm), and a height of approximately 36 inches (91.4 cm) was assembled. The example apparatus was mounted on four 4 inch (10.2 cm) diameter wheels having a width of 1 in (2.5 cm). The forward pair of wheels were set within a wheel housing about 5.5 inches (14 cm) long. The rear pair of wheels had braking mechanisms and were mounted approximately 2.3 inches (5.8 cm) behind the lower rear vertical support bar. Between the forward pair of wheels spanned the forward horizontal foot support bar which had a length of approximately 23.75 inches (60.3 cm). The rear top of the wheel houses were attached to the forward vertical support bars of the frame, such that the forward horizontal foot bar is set 3.75 inches (9.5 cm) forward of and orthogonal to the forward vertical support bars. The forward vertical support bars were approximately 32 inches (81.3 cm) tall and were hollow so that a pair of extension rods were enclosed within them. The extension rods were 28 inches (71.1 cm) long and fit completely within the forward vertical support bars. The extension rods were connected to the inside bottom of the forward vertical support bars by an elastic band. At the top of the extension rod was a rubber ball that was 3 inches (7.6 cm) in diameter. The lower rear vertical support bars were spaced approximately 19 inches (48.3 cm) behind the forward vertical support bars. The lower horizontal side support bars were approximately 19 inches (48.3 cm) long and 13.5 inches (34.3 cm) above and parallel to the floor. The upper horizontal side support bars were approximately 18 inches (45.7 cm) above and parallel to the lower horizontal side support bar. The top horizontal cross bar extended between and orthogonal to the forward vertical support bars and had a length of 23.75 inches (60.3 cm). Installed on the top horizontal cross bar were 2 hollow wooden tube handles, each 7.75 inches (19.7 cm) long with an outer diameter of 2 inches (5.1 cm) and an inner diameter of 1 inch (2.5 cm) which were able to slide along the top horizontal cross bar. In this example embodiment, foam grip handles were installed at the corners between the upper horizontal side support bar and the rear vertical support bar. The foam grip handles were 17.5 inches (44.5 cm) long. The example apparatus also had installed 6 natural rubber loops for use as resistance bands. The loops were 27 inches (68.6 cm) wide when wrapped on spools around the outside of the pair of forward vertical support bars. Three of the loops were set around a pair of spools near the top of the frame, approximately 32 inches (81.3 cm) above and parallel to the floor, and were grouped together in a band about 1.75 inches (4.4 cm) tall. The remaining 3 loops were set in a pair of spools near the bottom of the frame, approximately 10.5 inches above and parallel to the floor. The lower bands were wrapped in a durable nylon fabric cover which was sealed with a hook and loop seam.

Additionally in the example apparatus a track was constructed of rolled steel that was formed to have the following dimensions:

The track was made from steel having 2 parallel tracks of 63.75 inches (161.9 cm). The parallel tracks had a web of approximately 2 inches (5.1 cm) between 1 inch (2.5 cm) tall flanges. The parallel tracks were attached to each other and held at a fixed distance of 23 inches (58.4 cm) apart by a pair of parallel support bars positioned perpendicular to the tracks at one end. The pair of 1.5 inch (3.8 cm) wide support bars were spaced 3.75 inches (9.5 cm) apart. The outer surface of the track was fitted with foam rubber cut from a split length of ARMAFLEX foam tubing having an inside diameter of ⅞ inches (2.2 cm) and a 0.5 inch (1.3 cm) thickness.

The web of metal such as steel was cold rolled to have two opposite flanges on either side of the web thereby forming a length of track having a cross section profile which is generally u-shaped.

Although the typical embodiment will be approximately of the dimensions described above, it is understood that a larger frame and track assembly may be useful for users in a wheelchair. Likewise, a smaller frame and track assembly may be useful for children or small adults.

As discussed above there are many possible exercise and stretching activities a user may perform with the subject exercise and therapy apparatus, with and without the assistance of a second user. It will be understood that the second user may be a therapist, a friend or family member or another patient.

A few exemplary exercises are described herein, although it will be recognized that many other exercises not described will be possible without departing from the scope of this disclosure. Exercises are typically accomplished when at least one user transmits a force through the moveable frame. For example, when the frame is grasped and moved with the user's hands, the hands and frame move legs or feet resting upon the lower elastic element. Similarly, the feet may push or pull on the frame supports or lower resistance bands while the user's hands grasp the upper resistance bands. Thus the hands and arms can move with the frame, or resist such movements as may be desired. The exercises described herein are illustrative and not limiting.

Exercise Example 1

In use, a person may sit on a chair or a wheel chair in front of the frame and place the soles of his feet on the lower resistance band. The seated person then pushes down with his legs against the resistance band and then returns to the starting position. The user may do this repeatedly for any desired period of time to achieve exercise while in a seated position. This is very beneficial for elderly people or people with limited mobility. Further, a simple resistance bouncing of the legs may provide proprioceptive benefits to certain patients.

As an alternative, an assistant or therapist may use his hands to press down upon a seated patient's knees and assist the patient in exercising. The therapist uses his own force to impart the necessary force to move the band downward, thus simulating the exercise described above. The therapist may push at any desired speed and/or intensity. In some methods, the patient's knees may be gently pressed to allow downward and upward movement or it may be done more vigorously to the point that the patient's feet appear to be bouncing or marching up and down on the band. This allows for increased blood flow in the patient and it limbers up the patient's joints. In some instances, after the therapist assists the patient by manually pressing on the patient's knees as described above, the patient is them conditioned to be able to perform the exercise unaided.

Exercise Example 2

With the brakes on, so that the apparatus does not roll toward him, a user may extend his arms and grasp the upper resistance band or bands with one or both hands. The user then pulls the band inward and toward himself and then returns the band to its starting position. The user may do this repeatedly for any period of time to achieve upper body exercise while in a seated position. This is beneficial for elderly people, people with limited mobility or people in rehab for various injuries.

As an alternative, instead of setting the brakes, a therapist may support the apparatus by putting his feet on the front horizontal support rod. In other instances, the therapist could grip one or more of the upper resistance bands thereby providing opposing force to the user's pulling force. This adds to the resistance encountered by the patient.

In cases where one participant is stronger than the other, such as when the second user is a therapist or caretaker, the therapist can coordinate or assist the pushing and pulling motions for the benefit of the patient. The therapist can hold the frame firmly with hands or feet, by leaning on frame cross-pieces, or alternatively may utilize one or both of the upper and lower resistance bands. In every instance, the user can control the speed of the exercise.

Exercise Example 3

As a user sits stationary in a chair, the apparatus easily allows for back and forth movement. This permits a user sitting in the chair with his feet planted on the ground to perform upper body exercise by grasping the upper front horizontal support rod or the side frame members and pull the entire apparatus toward himself and then push it back away from himself.

Exercise Example 4

This exercise is similar to exercise example 3, but is modified so that rather than placing his feet on the floor, the user positions his feet on the lower resistance band. As the user grasps the front horizontal support bar or side bars he pulls the entire device toward himself, working against the resistance formed by his legs pushing the device away from himself. Thereafter, the user pushes the device to its starting position. A user, thus, achieves exercise of his upper body muscles while remaining seated in a chair.

Exercise Example 5

The therapist can sit facing the patient with both legs firmly on the lower portion of the apparatus frame. The therapist's hands may grasp a portion of the upper resistance strap. When multiple resistance bands are utilized in the device, the therapist can grasp a few of these at once. The patient sits within the opening of the frame, facing the therapist, and places his feet on the floor or lower resistance band, or one foot on each, while using his hands to grasp the remaining upper bands. Here the exercise activity is a rocking action, to and fro between the participants with alternating cooperating movements or opposite resistance movements.

The principle resistance movements will be pushing toward each other or pulling apart, but many variations and rhythms are possible.

Exercise Example 6

A stationary patient can roll the frame very close to his body, positioning hands and elbows as far rearward as possible for a gentle form of back exercise.

It will be recognized that the subject apparatus may be controlled by the user alone, or by the therapist alone, or by both participants together.

Many alternative embodiments are possible without departing from the scope of the subject disclosure. One possible movement mechanism could use low-friction sliders or glide pads at the bottom of each leg of the frame instead of wheels. In addition, in an embodiment using low-friction sliders or glide pads, it may be useful to modify the track to cooperate with the low-friction sliders or glide pads. Other movement mechanisms can include a linear rack gear and pinion gear arrangement, or ball bearings on the moveable frame configured to cooperate with the guide rails.

It is contemplated that the apparatus may be modified to accommodate a bedridden person, by providing a track that lays along both sides of the bedridden user. The modified apparatus would have the lower section of the apparatus frame, without the forward horizontal foot bar, so that the frame fits over the body of the user and the user lays within the frame. The user could then reach up and use his hands to pull or push on the foot resistance bands. In this embodiment, the cover for the foot bands would be removed. Alternatively, if the bedridden user wanted to exercise his legs, he could put his feet on the foot bands to push or pull the apparatus in cooperation with a therapist or friend.

It is also contemplated that in a further embodiment, a platform or table may be installed on an upper portion of the frame, providing a stable surface to support user selected items, such as a book, tablet or computer, food items, writing materials, craft and hobby items and the like. Thus, users can perform exercises while attending to other interests. This will be particularly beneficial in an office setting where sedentary workers will enjoy movement and exercise while being able to perform their desk job activities.

It should be understood that the preferred embodiments were described to provide illustrations of the principles of the invention and its practical application to thereby enable one of ordinary skill in the art to utilize the invention in various embodiments and with various modifications as are suited to the particular use contemplated. All such modifications and variations are within the scope of the invention. Moreover, although the Figures herein show preferred frames for supporting resistance bands, such structures are exemplary and shall not be construed as limiting the invention. The invention relates to any linearly movable support bars as described for receiving resistance or tension bands as described.

The invention now being fully described, it will be apparent to one of ordinary skill in the art that many changes and modifications can be made thereto without departing from the spirit or scope of the invention set forth herein.

The invention claimed is:

1. An exercise and therapy apparatus comprising: a linearly movable frame having at least two substantially parallel vertical posts, each of said vertical posts having an upper aspect and a lower aspect;

a plurality of fixed wheels attached to each vertical post of the moveable frame and wherein the wheels are oriented offset from a longitudinal axis of the said vertical posts for stability for movement in a substantially straight line;

at least one elastic resistance member mechanically attached substantially horizontally to respective lower aspects of said at least two vertical posts, said elastic resistance member urging movement of the apparatus along said substantially straight line when stretched by a user, wherein the frame is configured to engage a stationary user relatively within a portion of the frame and thereby permitting forward and reverse linear, reaching and retrieving motions.

2. The apparatus of claim 1 wherein the at least one elastic resistance member is a lower elastic resistance member mechanically attached horizontally to the frame in front of the user's legs and configured to engage the user's feet or legs in a forward and reverse linear elastic resistance fashion.

3. The apparatus of claim 2 wherein the at least one elastic resistance member is comprised of a plurality of elastic bands configured to facilitate selection of different resistance strengths by the user.

4. The apparatus of claim 3 wherein the at least one lower elastic resistance member is configured for user leg stretching or bouncing motions.

5. The apparatus of claim 1 further comprising a horizontal support bar attached at each end to opposite sides of the vertical posts of said frame and parallel to the lower elastic resistance member and configured for use by a second user to oppose the linear motion of the first participant.

6. The apparatus of claim 1 further comprising at least one upper elastic resistance member, said upper resistance member attached substantially horizontally to respective upper aspects of said vertical posts of said frame in front of the user's torso and configured to engage and resist the user's hands or arms in a forward and reverse linear fashion.

7. The apparatus of claim 6 wherein the at least one upper elastic resistance member is configured for user stretching, bouncing or gripping motions.

8. The apparatus of claim 7 wherein the at least one upper elastic resistance member is comprised of a plurality of elastic resistance straps configured to be selected by a user for variable resistance strength or shared with another user for multiple user participation.

9. The apparatus of claim 1 wherein the plurality of fixed wheels are configured to engage a linear guide track.

10. The apparatus of claim 1 wherein each wheel is paired with a second tandem or in-line stabilizing wheel.

11. The apparatus of claim 1 further comprising a hand gripping member for strengthening user hands and facilitating stretching extension of user arms.

12. The apparatus of claim 11 wherein the hand gripping member is a rotatable or squeezable grip element.

13. The apparatus of claim 1 further comprising arm stretching extension members, said arm stretching extension members comprising measured rods elastically attached to the frame for resistance.

14. The apparatus of claim 1 further comprising at least one track for guiding the apparatus on a fixed linear path on said surface.

15. The apparatus of claim 14 further comprising a plurality of parallel tracks affixed to a surface between the moveable frame apparatus and said surface and configured to guide each of the frame wheels on a fixed linear path.

16. The apparatus of claim 14 further comprising a vertical adjustment to incline the track.

* * * * *